US006886967B2

(12) United States Patent
Quang

(10) Patent No.: US 6,886,967 B2
(45) Date of Patent: May 3, 2005

(54) LUMINAIRE

(75) Inventor: Nguyen Van Quang, Bispingen (DE)

(73) Assignee: WE-EF Lighting USA, LLC, Sewickley, PA (US)

( * ) Notice: Subject to any disclaimer, the term of this patent is extended or adjusted under 35 U.S.C. 154(b) by 0 days.

(21) Appl. No.: 10/099,458

(22) Filed: Mar. 15, 2002

(65) Prior Publication Data

US 2003/0174502 A1 Sep. 18, 2003

(51) Int. Cl.[7] ..... F21V 17/00

(52) U.S. Cl. ..... 362/455; 362/294; 362/308; 362/333; 362/373

(58) Field of Search ..... 362/293, 294, 362/373, 345, 455, 257, 456, 331, 308, 333

(56) References Cited

U.S. PATENT DOCUMENTS 1,968,072 A * 7/1934 Creighton
4,241,388 A * 12/1980 Green ..... 362/268
4,546,420 A * 10/1985 Wheeler et al. ..... 362/268
4,604,680 A * 8/1986 Levin et al. ..... 362/293
4,879,638 A * 11/1989 Pavelin ..... 362/294
5,041,950 A * 8/1991 Tyson ..... 362/96
5,287,258 A * 2/1994 Remus ..... 362/256
5,404,283 A * 4/1995 Yantz et al. ..... 362/267
5,607,228 A * 3/1997 Ozaki et al. ..... 362/263
5,651,609 A * 7/1997 Pelton et al. ..... 362/294
5,727,873 A * 3/1998 Tyson ..... 362/294
6,382,822 B1 * 5/2002 Maekawa et al. ..... 362/522
6,543,923 B2 * 4/2003 Tamai ..... 362/521

FOREIGN PATENT DOCUMENTS

DE 2 079 434 A 1/1982
GB 2 130 353 A 5/1984

* cited by examiner

*Primary Examiner*—Thomas M. Sember
*Assistant Examiner*—Jacob Y. Choi
(74) *Attorney, Agent, or Firm*—Webb Ziesenheim Logsdon Orkin & Hanson, P.C.

(57) ABSTRACT

A luminaire comprising a housing with an opening on one side. A lamp and reflector are contained in the housing. The luminaire includes an arrangement to distribute radiated heat in front of the lamp away from an area of the center line of radiation towards areas located laterally with respect to the center line of radiation of the luminaire.

13 Claims, 1 Drawing Sheet

LUMINAIRE

BACKGROUND OF THE INVENTION

1. Field of the Invention

The present invention relates to luminaires.

2. Description of Related Art

Luminaires are generally known, for example, in the form of floodlights or in-ground uplights. They include a housing, an opening on one side, and contain a lamp together with a reflector. In order to prevent the entry of water in exterior lighting applications, all current luminaires include a transparent lens that covers the open side of the housing. This way, water is reliably prevented from entering the housing to the effect of damaging the electrical components of the luminaire.

One disadvantage of luminaires of the prior art is that high temperatures of over 120° C. may be experienced at the surface of the cover lens. Due to these high temperatures, there is a significant risk of being burned when touching the cover lens.

In order to eliminate this disadvantage, prior art luminaires have an infrared filter which can be mounted between the lamp and the cover lens to reflect the radiated heat. One disadvantage of this prior art technical solution is that the heat which is reflected by the infrared filter will accumulate in the area next to the lamp and the reflector. This will reduce the life of the lamp. There is an additional risk that electrical components of the luminaire, the ignitor, for example, may heat up and may be destroyed due to overheating. Another disadvantage of the technical solution of the prior art is the high cost of the infrared filter which leads to an accordingly higher price for the luminaire.

SUMMARY OF THE INVENTION

An object of the invention is to design a luminaire that prevents excessive heating of the cover lens and is simple and inexpensive to produce.

The technology relevant to the present invention is based upon the premise that the temperature of the cover lens is highest at the area of the center line of radiation. Based upon this, the object of the present invention to distribute radiated heat that is located in front of a lamp away from this area and toward areas located laterally with respect to the center line of radiation of the luminaire. By doing so, the temperature of the cover lens is significantly reduced at the area of the center line of radiation. The effect overall is that the peak temperature of the cover lens is significantly reduced, which results in a corresponding reduction of the risk of being burned by touching the cover lens. While a slightly higher temperature will be generated in areas to either side of the center line of radiation of the luminaire, which take up the distributed heat, such temperatures should not generate any additional disadvantage. Furthermore, the luminaire of the present invention is simple in design and thus inexpensive to produce.

The arrangement to distribute the heat away from the area in front of the heat generating body, such as a lamp and the center line of radiation of the luminaire toward areas sideways or laterally of the center line of radiation of the luminaire can be done in various ways. Such an arrangement can contain a medium to diffuse the thermal radiation that originates from the lamp to at least partly away from the area of the center line of radiation of the luminaire toward areas to either side of the center line of radiation. A more balanced distribution of the heat to these lateral areas is achieved by diffusing the radiated heat.

The arrangement used to diffuse the heat radiation can be designed in various ways. In one especially advantageous design of the aforementioned technical solution, the arrangement includes a spread lens which is mounted in the direction of the radiation between the lamp and a transparent cover lens. The spread lens acts to diffuse and spread light in an even manner. Such spread lenses are available as standard components and are inexpensive, which renders the luminaire of the present invention cost competitive.

In a plan view, the spread lens can cover the entire reflector. This would be disadvantageous however, since all the light that has been reflected by the reflector will then be diffused by the spread lens. This impedes the light distribution curve of the luminaire which, however, depending on the use of the luminaire may not necessarily be a disadvantage. In addition, the efficiency of the luminaire will be reduced. In one especially advantageous design of the aforementioned technical solution to include a spread lens, the area of the spread lens is smaller, preferably much smaller, than the area that is contained by the rim of the reflector in such a way that the areas of the reflector that are, laterally, or to one side of the lamp will reflect the heat past the side of the spread lens. In plan view and with this technical solution, the spread lens only partially covers the reflector. By use of this technical solution, the light that is reflected by lateral areas of the reflector, for example, can exit the luminaire unimpeded in such a way that its light distribution curve and efficiency will only be slightly affected. Apart from this, the area between the spread lens and the reflector communicates with the area between the spread lens and the inner side of the cover lens to the effect that the heat will be distributed in a more even manner and the risk of heat accumulation will be further diminished with this technical solution.

In order to allow the reflected light to exit, the spread lens could possibly be designed with holes or slots or similar openings. One advantageous development of the present invention is that a circular slot can be formed between the rim of the spread lens and the reflector. By use of this the circular slot or opening, light is able to exit through the circular slot unimpeded by the spread lens.

The distance between the spread lens and the lamp can be freely chosen as required for any specific application. In one embodiment, the surface of the spread lens that faces the lamp is on the same level as the rim of the reflector. In this embodiment, the spread lens is mounted in the direction of the radiation right in front of the lamp which leads to effective diffusion of the heat radiation that is emitted by the lamp.

In another embodiment, the spread lens is mounted essentially in the center line of the lamp. In this embodiment, asymmetries with regard to the influence on the light cone of the luminaire will be reduced.

In order to prevent further possible asymmetries that may influence the light cone of the luminaire, the spread lens can be constructed essentially in a circular shape, especially whenever the reflector is of a symmetrical beam design and the light cone that originates from the luminaire is then also essentially symmetrical.

In another technical development of the embodiment with the spread lens, the spread lens is contained in a circular lens holder which is supported by an arrangement of thin supports and by a part of the housing away from the reflector. This technical solution is especially simple and inexpensive to produce. The thin supports will have an insignificant effect on the light radiation.

It is most suitable that the spread lens is comprised of a transparent material. This permits any influence upon the light cone of the luminaire in the area of the spread lens to be kept low.

Finally, one development of the embodiment with the spread lens teaches that the spread lens can be prismatic, patterned or configured, especially etched, on its surface facing the lamp and/or on its surface opposite the lamp. The surface of the spread lens can also be grit blasted or otherwise treated. Such spread lenses can be manufactured easily and cost competitively.

The invention is explained in greater detail below with reference to the preferred embodiment illustrated in the accompanying figures.

DESCRIPTION OF THE PREFERRED EMBODIMENT

Figure 1:
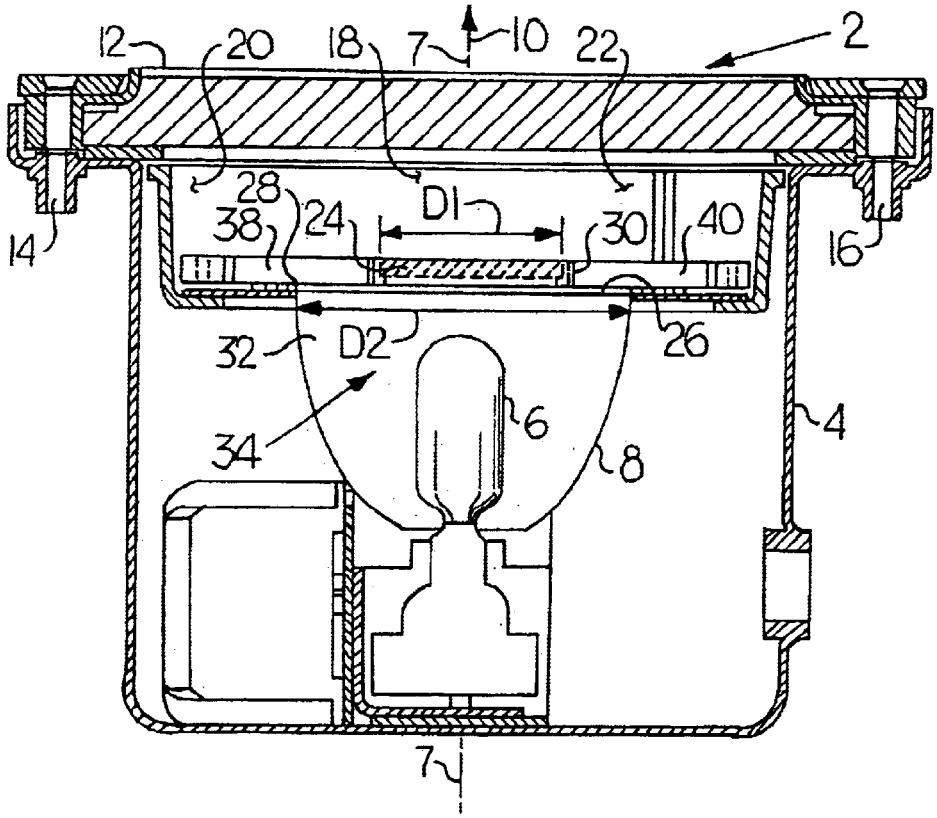
FIG. 1 shows an elevational view, partially in a section, of one embodiment of a luminaire of the present invention.

FIG. 1 shows a luminaire 2 that includes of a pot-shaped housing 4, open on one side, containing a lamp 6 which is surrounded by a reflector 8 in a shape which is rotationally symmetrical to the center line of radiation 7 of the luminaire 2. The reflector 8 is mounted inside the housing 4 and opens up in the direction of the radiation of the luminaire 2 as marked by an arrow 10 in FIG. 1. The lamp 6 is connected to the electricity supply line in a way generally known to a technician skilled in the art and is therefore not shown in the drawing. The electrical components necessary for the supply of electricity are known in the art and are not explained below.

In order to prevent the entry of water in exterior lighting applications of the luminaire 2 which would lead to damage of the electrical components, the luminaire 2 is protected at the open side of the housing 4 with a transparent cover lens 12. The cover lens 12 is held pressed against the housing by an arrangement of screws 14 and 16.

Figure 3:
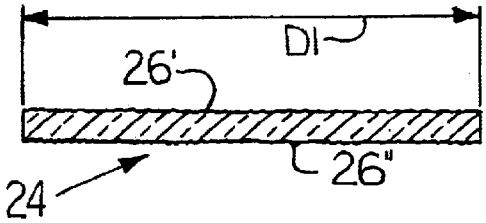
FIG. 3 shows a cross-sectional elevational view of a lens made in accordance with the present invention having an etched surface.
Figure 4:
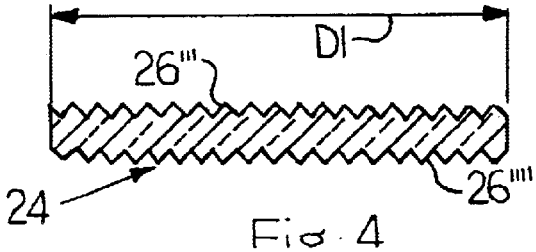
FIG. 4 shows a cross-sectional elevational view of a spread lens made in accordance with the present invention showing a spread lens with a pattern on its surface.

The luminaire 2 of the present invention also has an arrangement to distribute the heat in the direction of the radiation 10 in front of the lamp 6 away from the area 18 of the center line of radiation 7 of the luminaire 2 toward areas 20, 22 that are located laterally or sideways with respect to the center line of radiation 7 of the luminaire 2. The arrangement to distribute the heat includes a medium to diffuse the radiation away from the area 18 of the center line of radiation 7 of the luminaire 2 toward areas 20, 22 that are located laterally with respect to the center line of radiation 7 of the luminaire 2. The arrangement includes a spreads lens 24 of a circular shape which is contained in a lens holder 34, to be explained in greater detail below with reference to FIG. 2, and which is mounted in the center line of the lamp 6 and a distance is kept between the spread lens 24 and the lamp 6. The spread lens 24 is separate from the lamp 6 and coaxial with the center line 7. The spread lens 24 includes a transparent material and is etched on its surface 26 facing the lamp 6. In the illustrated preferred embodiment, the surface 26 is at the same level as the rim 28 of the cup-shaped reflector 8 in such a way that the spread lens 24 is directly mounted in front of the lamp 6. The outer diameter $D_1$ of the spread lens 24 is less than the diameter $D_2$ of the rim 28 of the reflector 8. As shown in FIGS. 3 and 4, the spread lens 24' may include etching on surfaces 26' and 26" where surface 26" faces the lamp 6 and surface 26' faces away from the lamp 6. As shown in FIG. 4, the spread lens 24" may include a pattern on surfaces 26'" and 26"" where surface 26'" faces away from the lamp 6 and surface 26"" faces the lamp 6. Spread lenses 24' and 24" may be used in lieu of lens 24.

It can be seen from FIG. 1 that the area of the spread lens 24 is smaller than the area that is contained by the rim 28 of the reflector 8 in such a way that a circular slot 32 is being formed between the rim 30 of the spread lens 24 and the reflector 8. This way, areas of the reflector 8 that are beside the lamp 6 will reflect light past the side of the spread lens 24 with no affect on a light cone of the luminaire 2 through the spread lens 24 in this area. Because the spread lens 24 is made of a transparent material, the light cone of the luminaire 2 will be only slightly affected at the area of the spread lens 24, whereby, due to the circular shape of the spread lens 24 and its positioning at the center line in front of the lamp 6, asymmetries that affect the light cone of the luminaire 2 are largely prevented.

When the luminaire 2 is switched on, radiation that originates from the lamp 6 will hit the etched surface 26 of the spread lens 24 and will be at least partly diffused by it away from the center line of radiation 7 toward areas 20, 22 sideways of the center line of radiation 7 of the luminaire 2. This allows the external lens temperature at the center of the cover lens 12 to be significantly reduced in comparison with luminaires that have been engineered using technologies of the prior art. The peak temperature of the cover lens 12, for example, could be reduced from 90° C. without the use of a spread lens to about 70° C. with the use of a spread lens. Even though the areas at the edge of the cover lens 12 will warm up slightly more than without the use of a spread lens, this is not of any further disadvantage.

Figure 2:
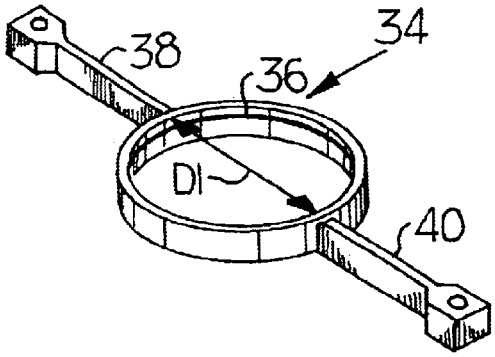
FIG. 2 shows an enlarged perspective view of a circular lens holder for a spread lens of the luminaire as illustrated in FIG. 1.

FIG. 2 shows the lens holder 34 for the spread lens 24. The lens holder 34 is of a circular ring shape; the ring has an internal diameter that matches the external diameter of the spread lens 24. As its circular inner side, the lens holder 34 features a body having a ledge 36 which serves to support the spread lens 24 when it is installed as shown in FIG. 1. The circular lens holder 34 has two thin supports 38, 40 attached in order to allow the lens holder 34 to be supported by the rim 28 of the cup-shaped reflector 8, as shown in the mounted position in FIG. 1. In this arrangement, the outer diameter of the spread lens is smaller than an upper diameter of the rim of the reflector so that areas of the reflector that are located laterally with respect to the lamp will reflect light past a side of the spread lens unimpeded.

While a specific embodiment of the invention has been described in detail, it will be appreciated by those skilled in the art that various modifications and alternatives to those details could be developed in light of the overall teachings of the disclosure. The presently preferred embodiment described herein is meant to be illustrative only and not limiting as to the scope of the invention which is to be given the full breadth of the appended claims and any and all equivalents thereof.

What is claimed is:

1. A luminaire, comprising:

a housing, wherein one side of the housing is open;

a lamp;

a cup-shaped reflector having a rim, wherein the lamp and the reflector are contained in the housing; and means separate from said lamp, to distribute radiated heat in front of the lamp away from an area of the center line of radiation toward areas located laterally with respect to the center line of radiation of the luminaire, wherein the means to distribute the radiated heat in front of the lamp from an area of the center line of radiation towards the areas located laterally with respect to the center line of radiation of the luminaire, includes a medium to diffuse radiation that originates from the lamp, at least partially away from the area of the center line of radiation of the luminaire towards the areas located laterally to the center line of radiation, the lamp and the reflector coaxial with the center line and a lens holder, the medium to diffuse the radiation comprises a spread lens, which is mounted in the direction of the radiation and is located between the lamp and a transparent cover lens, the lens holder including a body having a ledge to support the spread lens and a plurality of supports, the supports supported by the rim of the reflector, and wherein an outer diameter of the spread lens is smaller than an upper diameter of the rim of the reflector so that areas of the reflector that are located laterally with respect to the lamp will reflect light past a side of the spread lens unimpeded.

2. The luminaire as claimed in claim 1, wherein a circular slot is formed between a rim of the spread lens and the reflector.

3. The luminaire as claimed in claim 1, wherein a surface of the spread lens that faces the lamp is at a same level as the rim of the reflector.

4. The luminaire as claimed in claim 1, wherein the spread lens is mounted essentially in the center line of the lamp.

5. The luminaire as claimed in claim 1, wherein the spread lens has an essentially circular shape.

6. The luminaire as claimed in claim 1, wherein the spread lens comprises a transparent material.

7. The luminaire as claimed in claim 1, wherein the spread lens includes a pattern on a surface of the spread lens facing the lamp.

8. The luminaire as claimed in claim 1, wherein the spread lens includes a pattern on a surface of the spread lens facing the lamp and on the surface of the spread lens opposite the lamp.

9. The luminaire as claimed in claim 1, wherein the spread lens includes a pattern on the surface of the spread lens opposite the lamp.

10. The luminaire as claimed in claim 1, wherein the spread lens is etched on the surface of the spread lens facing the lamp.

11. The luminaire as claimed in claim 1, wherein the spread lens is etched on the surface of the spread lens facing the lamp and on the surface of the spread lens opposite the lamp.

12. The luminaire as claimed in claim 1, wherein the spread lens is etched on the surface of the spread lens opposite the lamp.

13. A method of providing a cooler cover lens of a luminaire, comprising the steps:

providing a luminaire having a housing wherein one side of the housing is open, a lamp which generates and radiates heat, a cup-shaped reflector having an upper rim, wherein the lamp and the reflector are contained in the housing, and a spread lens contained within the housing having an outer diameter less than the diameter of the rim, the spread lens supported by a lens holder, the lens holder including a body having a ledge to support the spread lens and a plurality of supports, the supports supported by the upper rim of the reflector;

distributing a portion of the radiating heat through the spread lens, to diffuse radiation that originates from the lamp in the luminaire;

scattering the portion of the radiating heat away from a center line of radiation towards areas located laterally with respect to the center line of radiation of the luminaire; and passing another portion of the heat radiating from the lamp unimpeded between an area defined by the upper rim diameter and the spread lens diameter, the another portion of the radiating heat not passing through the spread lens.

* * * * *